United States Patent [19]

Chapin

[11] 4,227,330

[45] Oct. 14, 1980

[54] BREECH-LOADING TO MUZZLE-LOADING FIREARM CONVERTING DEVICE

[76] Inventor: Paul D. Chapin, 1936 Fifth St., Ceres, Calif. 95307

[21] Appl. No.: 920,614

[22] Filed: Jun. 29, 1978

Related U.S. Application Data

[63] Continuation-in-part of Ser. No. 822,493, Aug. 8, 1977, abandoned.

[51] Int. Cl.[3] ..... F41C 21/10

[52] U.S. Cl. ..... 42/77; 42/51

[58] Field of Search ..... 42/77, 76 R, 51; 102/41

[56] References Cited

U.S. PATENT DOCUMENTS

| | | | |
|---|---|---|---|
| 158,221 | 12/1874 | Smith | 42/51 |
| 173,476 | 2/1876 | Ladd | 42/51 |
| 237,357 | 2/1881 | Zundorff | 42/77 |
| 3,780,464 | 12/1973 | Anderson | 42/51 |

*Primary Examiner*—Charles T. Jordan

*Attorney, Agent, or Firm*—Townsend and Townsend

[57] ABSTRACT

A conversion plug that is configured to be removably inserted into the breech of a breech-loading firearm, converting the firearm to one of a muzzle-loading type. The plug is provided with a primer-receiving chamber at one end and a series of passages that communicate the chamber to a region proximate the other end. The primer-receiving chamber is adapted to receive a percussion-type primer, detonation of which generates ignition products which are communicated via the series of passages to a main powder charge situated at the interior end of the plug to cause combustion of said charge and propel a projectile from the firearm.

13 Claims, 13 Drawing Figures

BREECH-LOADING TO MUZZLE-LOADING FIREARM CONVERTING DEVICE

This is a continuation-in-part of application Ser. No. 822,493, filed Aug. 8, 1977, now abandoned.

This invention relates to firearms and more particularly to a device that converts a breech-loading firearm to a percussion cap, muzzle-loading firearm.

DESCRIPTION OF THE PRIOR ART

Evolution of firearms, resulting in the metallic cartridge-receiving breech-loading arms used today, has seen many stages of development. One particular stage of development saw large use of the percussion lock, muzzle-loading firearm which, for the most part, was fired by communicating a first combustion via a small passage in the breech of the gun to the main propellant charge. Typically, this type of firearm was provided with a small channel, commonly called the touch-hole, to establish communication between the exterior of the breech of the firearm barrel and the firing chamber. A fulminate was placed at the exterior orifice of the channel and, when the trigger was pulled, a hammer or other type plunger was driven down on the fulminate, which exploded, sending its flame to the main charge.

Sometime between 1814 and 1820, the percussion cap was invented. A small quantity of fulminate was contained in a tiny copper shell covered by a tinfoil disc and sealed with a drop of shellac. The cap was placed on a nipple that formed the external orifice of the channel that led directly to the charge. When the hammer struck the cap a flame spurted down the channel and fired the gun instantly. There was no flash at the breech, no delay in firing, no loss of compression, and complete protection from dampness. The percussion-cap firearm was not superceded until the brass cartridge containing its exploder inside appeared in the middle of the 19th Century shortly before the American Civil War.

Although the brass cartridge firearm now dominates the weapons scene, percussion lock firearms are still in use and there has been of late a resurgence in such front-loading guns. In fact, the past few years have seen the sale of such arms and supplies become a million-dollar business, with such large firearm firms as Lyman, Thompson/Center and Colt now entering the field.

The gun fancier who becomes interested in muzzle-loading firearms for recreation can purchase, recondition, maintain and perhaps restore an authentic old firearm. Alternatively, he may purchase one of the many domestic or foreign-made replicas of percussion lock firearms presently supplying today's demand. He may also satisfy his interest by purchasing and assembling one of the many muzzle-loader kits available on the market today. However, any one of these alternatives presents a somewhat expensive venture into the muzzle-loading field.

Moreover, the gun fancier who desires to enter the muzzle-loading firearm sport, yet wishes to keep a hand in brass cartridge breech-loading firearms, must undergo the expense of purchasing and/or owning two firearms.

Several manufacturers today are selling muzzle-loading firearms which are adaptations and conversions of the breech-loading firearms that they typically produce. However, such adaptation of a breech-loading firearm to one of a percussion-ignited, muzzle-loading type involved threading the barrel breech (the chamber area) to accept a short removable breech plug fitted with a percussion nipple that is screwed centrally into its rear face. Conversion of the breech-loading firearm is such that it can no longer be used as a breech loader. Thus, the user again purchases this type of firearm for muzzle-loading use only and must purchase a breech-loading firearm if he wishes to own and/or use both types of firearms.

SUMMARY OF THE INVENTION

The above-identified problems are obviated by the present invention which provides a conversion plug that is easily and removably inserted into the breech of a breech-loading firearm to convert the firearm to one of the muzzle-loading variety. The invention is inexpensive to fabricate, simple to use, and highly effective in converting a breech-loading firearm to a muzzle-loading type, thereby allowing the firearm to serve a wide variety of applications.

The invention generally includes a conversion plug that is configured to be removably inserted into the breech of a breech-loading firearm. One end of the plug (the breech end) is provided with a primer-receiving chamber, adapted to receive a percussion-type primer. The ignition products generated by detonation of the primer (as by being struck by the firing pin of the firearm) are communicated from the primer-receiving chamber at one end of the plug to the other end of the plug (situated interior of the firearm barrel) by a series of passages formed in the plug.

In one embodiment of the present invention the series of passages formed in the plug include a first passage, a transverse passage and, in turn, a pair of second passages to establish fluid communication between the primer chamber and the distal end of the plug. In another embodiment a portion of the distal end of the plug is formed to have a reduced diameter, relative to the remainder of the plug, and the transverse passage communicates the primer chamber to a circumferential surface of the portion of and proximate the distal end. The passages contemplated are arranged in such fashion as to minimize back flash.

In use, the conversion plug is inserted into the breech of a firearm and a "battery-cup" primer inserted into the primer-receiving chamber. The firearm is loaded with a main charge (via the muzzle) and fired with a plunger, firing pin, or hammer is driven into the primer which explodes and sends its flaming and expanding gases to the main charge.

Various additional valve arrangements are also disclosed which, if desired, can be used in conjunction with the conversion plug of the present invention to further minimize back flash. One such arrangement utilizes a thin annular disc which is mounted in generally axial alignment with the breech plug and on the interior end thereof by a retaining member. The disc is of sufficient diameter and surface area to cover the openings which are formed at the end of the breech plug by the second passage pair. The disc is movable between a first portion adjacent the interior end of the plug to a second position spaced a predetermined distance from the interior end. The disc is moved from the first position to the second position by the expanding gases created by detonation of the primer and, subsequently, from the second position back to the first position by the expanding gases created by the ignited charge.

Another valve arrangement for minimizing back flash includes forming a valve chamber at the interior end of the first passage. The chamber slidably contains a valve member which is movable from a first position that seals the first passage to a second position which allows the detonation products of the primer to be communicated to the main charge. Movement of the valve member from the first position to the second position is effected by the pressure of the gases created by detonation of the primer. Similarly, movement of the valve member back to the first position is effected by the gases created by combustion of the main charge, which are communicated to the valve member by a vent hole that leads from the interior end of the plug to the valve chamber.

Finally, an embodiment of the present invention is disclosed which, if desired, provides the conversion plug with the capability of selectively aligning the percussion cap primer situated in the primer chamber of the plug to place the rear, striking surface of the primer in a generally coplanar relation with the breech end of the plug. This embodiment comprises a conversion plug that includes a generally hollow, cylindrical body member formed to fit into the breech of the firearm. An adjustment element is adapted to fit within the body and situated coaxial therewith, so that one end of the adjustment element forms the interior, bottom of the primer chamber. The communicating passages are formed in the adjustment element.

Threaded engagement is provided the body member and adjustment element so that circumferential rotation of the adjustment element moves it axially, relative to the body member. Such axial movement will also move the bottom of the primer chamber and, therefore, a percussion cap primer situated in the chamber to provide a coplanar relation between the strike surface of the primer and breech end of the conversion plug.

For a fuller understanding of the nature and advantage of the invention, reference should be had to the ensuing detailed description taken in conjunction with the accompanying drawings.

DETAILED DESCRIPTION OF THE PREFERRED EMBODIMENTS

Figure 1:
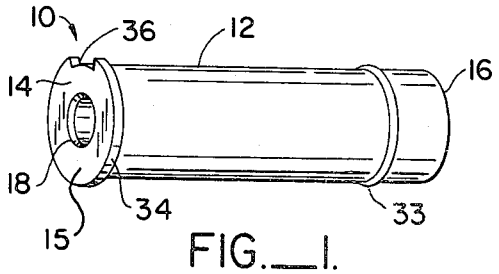
FIG. 1 is a perspective view illustrating the present invention.
Figure 2:
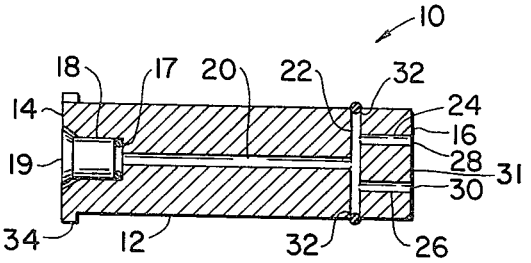
FIG. 2 is a side elevational view of the invention shown in FIG. 1 with a primer cap inserted in the primer chamber thereof.
Figure 3:
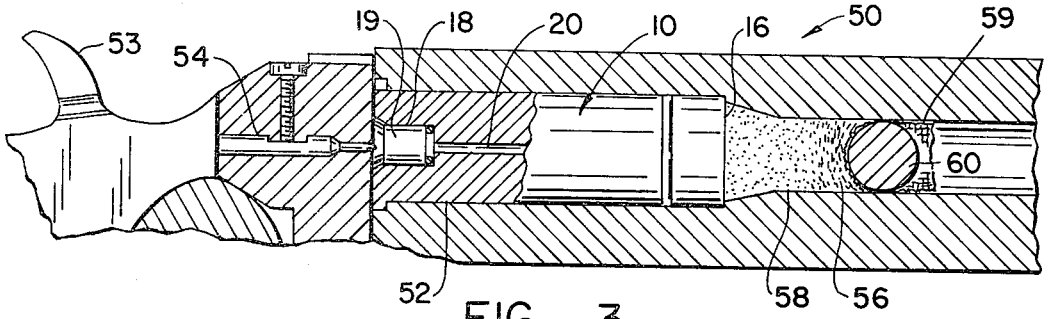
FIG. 3 is a partial cross-sectional view of a rifle with the conversion plug of the present invention inserted in a breech thereof illustrating use of the invention.

Turning now to the drawings, FIGS. 1–3 illustrate a first embodiment of the invention. As seen in these FIGS., a conversion plug generally designated by reference number 10 includes a cylindrical, elongate body 12 and opposing breech and distal ends 14 and 16, respectively. Formed in breech end 14 and coaxial with plug 10 is a primer-receiving chamber 18.

The primer chamber is formed and configured to receive a percussion cap-type primer 19 such as, for example, an ordinary battery cup-type primer. A typical type of percussion cap primer is commercially available through Remington Arms Company, Inc., Bridgeport, Conn. and sold under the trademark, Kleanbore. If desired, the interior of the primer chamber 18 can be provided with a dougnut-shaped seal 17, fabricated from a resilient material, to facilitate a seal between the primer 19 and plug.

Formed interior of the body 12 of the plug and establishing communication between primer chamber 18 and distal end 16 are a series of passages including a first passage 20, a second passage 22 and a pair of third passages 24 and 26. As FIG. 2 indicates, the first passage 20 is formed generally axial of body 12 and terminates in second passage 22, which is formed generally transverse the body and first passage. The third passages 24 and 26 are positioned in generally parallel, non-axial relation to the body and extend from the second passage 22 to the end 16, forming openings 28 and 30 in the planar end surface 31 of distal end 16.

Body 12 is generally configured to be slidably but snugly inserted into the breech or firing chamber of a breech-loading firearm. Circumferentially encircling body 12 is a channel 32 (FIG. 2) which receives the annular seal ring 33. Seal ring 33 acts to protect the interior surface of the breech of the firearm in which plug 10 will be inserted, as well as to aid in effecting a seal between the body 12 of the plug and the breech in which it is inserted. Additionally, the second or transverse passage 22 is situated so that it extends the diameter of the body 12, opening out into the encircling channel 32. Thus, seal ring 33 also acts to seal passage 22 as well as provide access thereto for cleaning, when desired.

Formed about the breech end 14 of the plug 10 is a circumferential flange 34. Flange 34 is provided with a notch 36 which allows the ejector system (not shown) of most breech-loading firearms to be bypassed and thereby keep from ejecting the plug 10 when the breech is opened.

Although other materials may be used, it is presently contemplated that the plug 10 will be fabricated from aluminum or other material having high heat conductivity. This allows the plug to communicate any heat generated therein by combustion of the main charge (explained below) quickly to the chamber and barrel of the firearm and thereby dissipated.

It is also presently contemplated that seal ring 33 will be fabricated from a rubberized material or other equally soft, resilient material.

The diameter of body 12 is dependent upon the diameter of the breech or firing chamber of the particular firearm in which plug 10 is to be used; the diameter should be sufficient to allow the plug to be easily inserted into the breech of the firearm, yet fit therein relatively snugly. The length of the body 12 of the plug is determined by the depth of the particular breech in which the invention will be used.

The diameter of the first and second passages 20 and 22, respectively, should be in the range of 0.0625 inches to 0.091 inches; passages 24 and 26 are approximately 1/16 inch in diameter.

Having thusly described the basic structure of the invention, its operation can now be understood with particular reference to FIG. 3. As illustrated, a breech-loading firearm 50 has inserted in the breech 52 thereof breech plug 10 of the present invention. As indicated, the plug 10 is inserted so that distal end 16 is situated interior of the breech 52. The primer chamber 18 receives a commercially available metallic cartridge primer 19. It should be noted that the primer chamber 18 is appropriately located in breech end 14 of the plug so that when the firearm 52 is readied for firing, the firing pin 54 is situated generally coaxial and proximate the cartridge primer 19.

With the conversion plug 10 inserted in the breech 52 of the breech-loading firearm 50, the firearm is now converted to one of a muzzle-loading variety. The main powder charge 56 is then introduced into the barrel 58 of the firearm 50 and located proximate the distal end 16 of the conversion plug. A wet or greased paper or cloth wadding 59 is then inserted into the barrel 58, usually wrapped with ball 60, and positioned proximate the powder charge 56. The percussion cap primer 19 can now be inserted in the primer chamber 18 of the conversion plug.

At this point, two caveats are in order. First, for safety's sake, insertion of the primer 19 should be the last step in readying the firearm for firing. This avoids the possible detonation of the primer while the firearm is being loaded.

Second, as most of those skilled in this art are probably aware, no muzzle-loading rifle, pistol or shotgun of any type can be safely fired with any form of modern smokeless powder. Therefore, again for safety's sake, any firearm or shotgun powder from a cartridge should never be used in any muzzle-loading type firearm. Even if made of modern steel and very strong, muzzle-loading firearms are normally not designed to handle the pressure curve of smokeless powder.

On the other hand, if the firearm 50 is of good condition, it will easily handle a double load of black powder or a replacement for black powder such as the substance referred to as "The Replica Black Powder" sold under the trademark Pyrodex by Pyrodex Corporation. In frontier days, double charges were used whenever the shooter needed more power or range. So, generally speaking, one cannot get into much trouble with black powder or its appropriate equivalent. However, it can get the gun in trouble if fouling is not kept down, as black powder and the water and greases normally used make quite a mess.

It is also appropriate to point out that the beginner should begin with round balls, used with wet or greased cloth patches. Conical bullets are a step up in experience and require self-made bullets of exactly the correct diameter for the particular barrel to be used therein and skilled loading techniques.

Thus loaded, the firearm 50 is fired when the hammer 53 of the firearm is driven into and strikes the firing pin 54 to cause impact detonation of the primer 19. Such detonation generates ignition of whatever charge utilized by the primer cap 19 (usually a fulminate) to generate hot gases which expand and are communicated via passages 20, 22, 24 and 26 to the main powder charge 56 situated at the interior (to the firearm 50) end 16 of the plug 10. The main charge is ignited and the resultant expanding gases of the combustion propels ball 60 out the barrel 58 of the firearm and on to its destination.

These same expanding gases created by combustion of the main charge 56 are not communicated to the primer chamber 18 to any appreciable amount. After ignition, the expanding gases created by the main charge enter the plug 10 via passages 24 and 26 to the transverse passage 22. It is believed that the use of two equal-length passages, such as passages 24 and 26, which terminate in the transverse passage 22, act to communicate the gases in such a manner to use them to substantially cancel and minimize any flashback.

Figure 4:
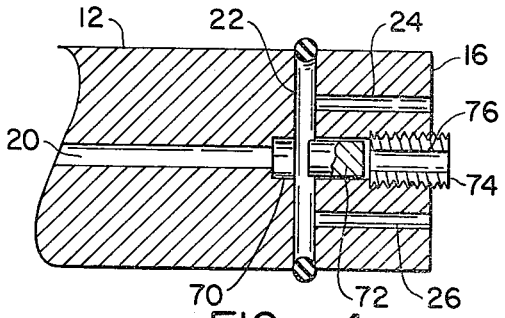
FIG. 4 is a further embodiment of the present invention illustrating the use of a sliding cylindrical valve to further minimize flashback.

The above-described structure adequately operates to convert a breech-loading firearm to one of a muzzle-loading variety with a minimum or negligible amount of flashbacks. However, in the event that stronger charges are contemplated, it may be beneficial to add additional valving to further minimize any possible flashback. Accordingly, illustrated in FIG. 4 is a valve arrangement that is provided the present invention, comprising a generally cylindrical valve chamber 70 disposed coaxial with the passage 20 of the plug 10. Contained within the chamber 70 is a valve element 72 configured to fit snugly but movably within the chamber. As can be seen, the chamber 70 is positioned at the junction of the interior distal end of the primary passage 20 and the transverse passage 22.

A threaded retaining member 74 is removably inserted into end 16 of the plug. Retaining member 74 functions to retain valve element 72 within the chamber 70, but also allows removal of the valve element for cleaning. A vent hole 76 is formed in the retaining member 74 to establish communication between the chamber 70 and exterior of the plug 10.

In use, the plug 10 is inserted in firearm 50 and the firearm loaded as described above. The ignition products created by detonation of the primer cap 19 will move the valve element 72 to a position adjacent to retaining member 74. This positional movement of valve element 72 removes it from the communication path between the primer chamber 18 and plug end 16 established by passages 20, 22, 24 and 26.

When the ignition products of the detonated primer cap 19 reach and ignite the main charge, the gases produced will be communicated to the valve element 72 via the vent hole 76 in retaining member 74 and cause movement of the valve element within chamber 70. The valve element is thereby moved to a position proximate the interior end of the primary passage 20, closing the passage. It should be noted that, as indicated in FIG. 4, valve element 72 is of sufficient length, relative to the locations of the interior end of passage 20 and transverse passage 22, so that when the valve element closes passage 20 it does so by also blocking transverse passage 22. Thus, the communicating path from the distal end 16 of the plug to the primer chamber 18 is interrupted at three places by valve element 72: The two passage/-valve element interfaces created by valve element interrupting passage 22 and the closure of the interior end of passage 20 when the valve element is positioned proximate thereto.

Figure 5:
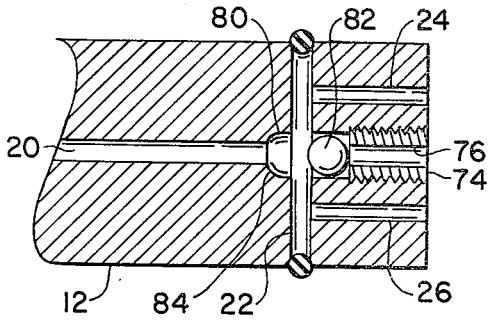
FIG. 5 is a further embodiment of the present invention illustrating the use of a small sphere-like ball valve mechanism.

FIG. 5 illustrates a still further embodiment of the present invention incorporating a valve mechanism that includes a generally cylindrical valve chamber 80 containing a spherically shaped valve element 82. In this embodiment, the junction between the primary passage 20 and the chamber 80 is provided with a hemispherically shaped valve seat 84 that is adapted to receive the valve element.

Other than the above-mentioned distinctions, the valve illustrated in FIG. 5 is basically the same as that of FIG. 4 in both operation and construction, including incorporation of a retaining element 74 that is provided with the vent hole 76. Thus, detonation of the percussion cap 19 will generate gases that are communicated to the valve chamber 80 via primary passage 20 to move the spherical valve element 82 away from the primer passage and allow the gases to be communicated to the main charge 56 via the transverse passage 22 and parallel passages 24 and 26. When the main charge is ignited, the back pressure created by the ignition will force the valve element 82 into its seat 84 thereby closing off passage 20 from any flashback.

Figure 6:
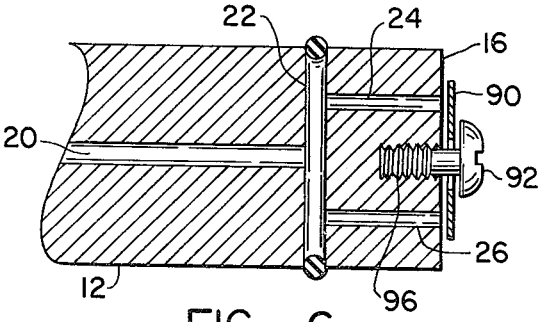
FIGS. 6 and 7 illustrate a further valve arrangement adapted for use with the present invention to minimize flashback.
Figure 7:
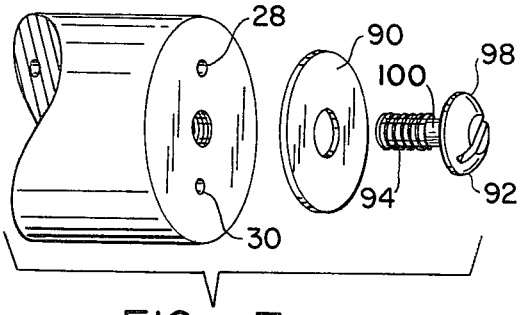

A further valve arrangement is illustrated in FIGS. 6 and 7 and comprises an annular disc 90 that is mounted in confronting relation to the planar surface 31 of end 16 by a bolt 92.

The disc-retaining member 92 has a threaded end 94 configured and adapted to engage threads 96 that are provided end 16 of the breech plug 10. The other end of the retaining bolt 92 is provided with a retaining head 98. Intermediate the threads and retaining head is a relatively smooth, obstruction-free neck which, when the bolt mounts the disc 90 to the end of the plug, allows the disc to be freely moved along the neck. In use, the plug is inserted in firearm 50 and the firearm loaded as described above. The expanding gases created by detonation of the primer cap 19 will be communicated to end 16 of the plug 10 via the passages 20, 22, 24 and 26, as described above, and will be expelled from the openings 28 and 30 to move the closure disc 90 away from the openings and to ignite the main powder charge 56. When so ignited, the expanding gases will force the disc 90 back toward the end 16 of the plug (along the smooth, obstruction-free neck 100 of the retaining bolt 92) to cover and close openings 28 and 30. Again, as with the valve arrangements discussed in connection with the description of FIGS. 4 and 5, flashback is eliminated.

Figure 8:
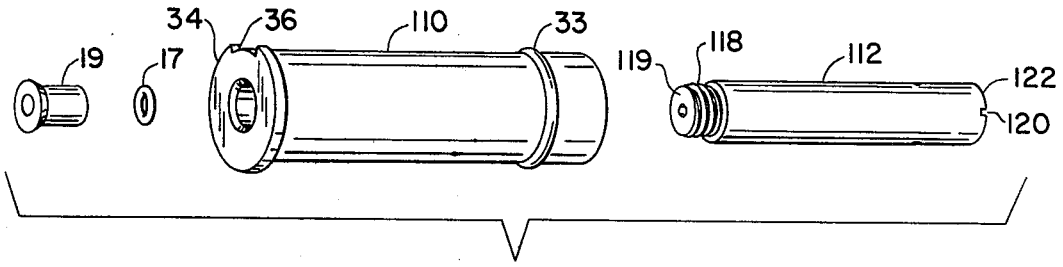
FIG. 8 is an exploded, perspective view of a further embodiment of the present invention illustrating the capability of axial adjustment of the percussion cap primer relative to the conversion plug.
Figure 9:
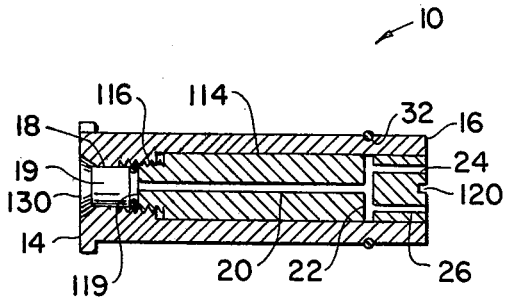
FIG. 9 is a cross-sectional view of the adjustable conversion plug of FIG. 8.

Turning now to FIGS. 8 and 9, a further embodiment of the present invention is disclosed which allows the conversion plug to be used with primer caps of varying longitudinal dimensions. This varying dimension could cause problems when using the conversion plug with breech-loading firearms having barrels that break open (or tip up) or pivot from the breech for loading. For example, the conversion plug discussed above (with reference to FIGS. 1–7) utilizes a primer chamber 18 of a specific depth and, therefore, adapted to receive a primer cap 19 (FIGS. 2–3) of a predetermined longitudinal dimension. If primer caps of longer longitudinal dimension are used, the rear or striking surface of the cap will protrude from the primer chamber and can interfere with the opening or closing of break-open or pivot barrel breech-loading firearms. Conversely, if the battery cap has a shorter longitudinal dimension, so that the cap appears recessed relative to the planar surface 15 of end 14, the firing pin may not adequately strike the cap, resulting in misfires. While these problems can be alleviated to some extent by the use of apparatus, such as seal 17 (FIG. 2), to "shim" the primer cap 19, this solution is not altogether satisfactory if a variety of primer caps are contemplated for use which have a large variance in their longitudinal dimensions.

Accordingly, FIGS. 8 and 9 disclose an embodiment of the present invention which provide for adjustment of the depth of primer receiving chamber 18, thereby providing for positional adjustment of the primer cap, relative to the plug 10, when situated within the primer chamber. The numbering used in FIGS. 8 and 9 will correspond to those numbers used in FIGS. 1–7 so that like elements will have like numbers. Thus, illustrated in FIGS. 8 and 9 is a conversion plug 10 that includes a barrel-like body member 110 and adjustment element 112.

The outer dimensions of body member 110 are the same as that of the plug shown in FIGS. 1–7. Additionally, body 110 is formed with circumferential channel 32 for receiving seal ring 33, circumferential flange 34 (with notch 36) but includes coaxial throughbore 114 (FIG. 9). Threads 116 are formed in the throughbore 114, proximate the breech end 14 of plug 10.

Adjustment element 112 is generally cylindrical in shape and formed with a threaded neck 118 at one end thereof and a linear slot 120 formed in the end surface 122 of the opposite end of the adjustment element. Passages 20, 22, 24 and 26 are formed in the adjustment element 112, establishing communication between the ends of the element.

Adjustment element 112 is configured to fit into throughbore 114 of body member 110 with the threads of threaded neck 118 engageable with threads 116 of the body member. With the adjustment element appropriately fitted in the body member, as shown in FIG. 9, the basic structure of the converter plug of the present invention is formed, including, if desired, the doughnut-shaped seal 17. In particular, primer chamber 18 is formed with a bottom (the end surface 119 of threaded neck 118) that is axially translatable when the adjustment element is circumferentially rotated while holding the body member fixed.

In use, therefore, a primer cap 19 is inserted in the primer chamber 18 of the plug (FIG. 9). If it appears that the primer end or striking surface 130 protrudes beyond or outside breech end 14 of the plug, when properly seated in the primer chamber (e.g., abutting the end surface 119 of the adjustment element 112), the adjustment element may be rotated to effect an axial translation of the element's end surface 119 away from breech end 14 of the plug. The striking surface 130 of primer 19 can thereby be brought into coplanar relation with the planar surface of breech end 14 of the conversion plug. Conversely, rotation of the adjustment element can be effected to axially translate end surface 119 toward breech end 14 to establish the desired coplanar relation between breech end 14 and the striking surface of the primer cap if needed.

Figure 10:
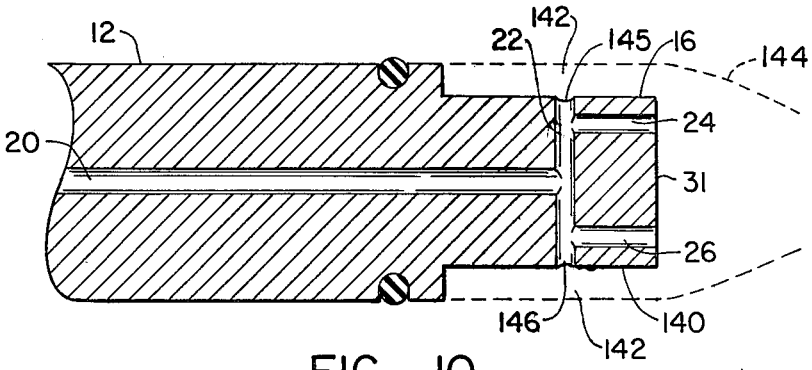
FIGS. 10 through 13 illustrate further embodiments of the present invention utilizing passages formed in the conversion plug to establish fluid communication between the primer chamber at one end of the plug and a distal end of reduced proportions and the circumferential surface proximate the distal end.
Figure 11:
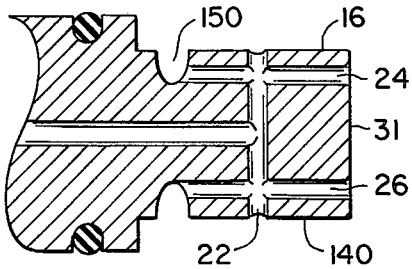
Figure 12:
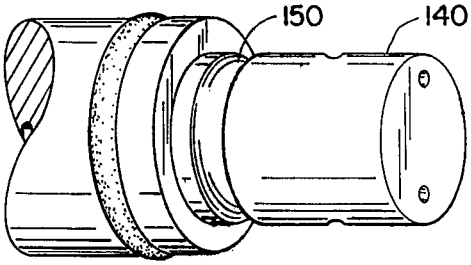

Referring now to FIGS. 10 through 12, additional embodiments of the present invention are illustrated. As shown, a portion proximate to distal end 16 of body 12 is formed with a reduced diameter relative to that of the remainder of the body. This reduction forms an outer circumferential surface 140 proximate the distal end which, in turn, provides a clearance 142 between surface 140 and the interior surface 144 (FIG. 10, illustrated in phantom) of the gun barrel in which the plug would be inserted. The clearance allows gun powder to be positioned about the circumferential surface 140, as well as at the planar surface 31 of distal end 16. Accordingly, the ignition products created by detonation of a primer cap travel, as described above, toward distal end 16 via passage 20 to transverse passage 22. From there the gases are communicated to the gun powder deployed at and about distal end 16 not only by passages 24 and 26, as with the embodiments shown in FIGS. 1–9, but via the transverse passage as well which has openings 145 and 146 at the circumferential surface 140. The charge is thereby ignited at four points. Flashback is minimized in the embodiment of the present invention illustrated in FIG. 10 by, it is believed, the cancelling effect described above.

A further embodiment of the present invention is illustrated in FIGS. 11 and 12. As in FIG. 10, the conversion plug 10 is formed so that the portion proximate distal end 16 is of a reduced diameter relative to body 12. Formed in surface 140 of the portion is a circumferential annular groove 150. Passages 24 and 26 extend to communicate planar surface 31 of distal end 16 and transverse passage 22 to groove 150. It is believed that the structure so described and illustrated in FIGS. 11 and 12 improves detonation of a charge placed at and about distal end 16 (when plug 10 is appropriately placed in the breech of a firearm) by communicating the ignition products of a detonated primer cap to a distributed number of areas of the charge. Further, the product produced by combustion of the charge is believed to be inhibited from traveling back to the primer chamber by the cancelling effect referred to above; and the provision of additional passages which act as relief ports, so to speak, for other of the passages subjected to the pressure generated by the combustion of the charge.

Figure 13:
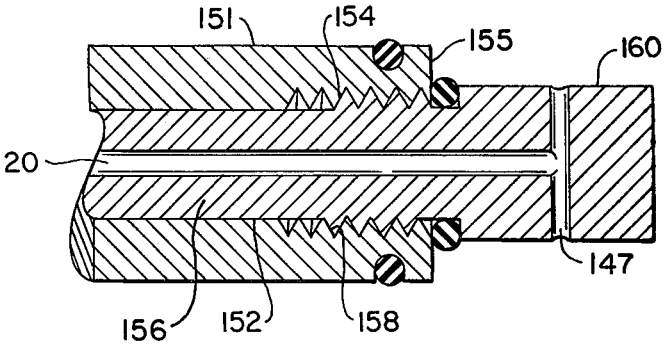

Finally, FIG. 13 illustrates an embodiment of the present invention in which only the transverse passage 147 functions to communicate the ignition products of a detonated primer cap. Additionally, the embodiment of FIG. 13 provides for positional adjustment of the primer cap in the same manner as discussed above in connection with FIGS. 8 and 9. As illustrated, a body member 151 is provided with a throughbore 152. Threads 154 are formed proximate the distal end 155 of the throughbore (the breech end of the plug is not shown in FIG. 13; it should be understood, however, that the breech end of the embodiment of FIG. 13 is substantially the same as that shown in FIGS. 8 and 9 with the threads moved to the distal end of the body). Inserted in the throughbore 152 is a cylindrically shaped adjustment element 156, having a threaded portion 158 and an extension 160. Formed in the adjustment element is passage 20, which communicates the primer chamber (not shown in FIG. 13) to transverse passage 147. Operation of the embodiment shown in FIG. 13 is the same as all other embodiments; and particularly the embodiments shown in FIGS. 10–12.

While the above provides a full and complete disclosure of the preferred embodiments of the invention, various modifications, alternate constructions and equivalents may be employed without departing from the true spirit and scope of the invention. For example, the embodiment of FIG. 13 could be manufactured so that transverse passage 147 opens into a circumferentially oriented groove (such as groove 150 of FIG. 11) formed in surface 140. The groove could then be provided with an annular grommet that would be adapted to fit in the groove. The groove/grommet combination would function as a valve assembly with the ignition products generated by a detonated primer cap forcing their way by the grommet. The grommet then functions, when the charge is ignited, as a closed valve to inhibit combustion products of the charge from entering transverse passage 147.

Therefore, the above description and illustrations should not be construed as limiting the scope of the invention, which is defined by the appended claims.

What is claimed is:

1. A device for installation in the breech of a breech-loading firearm to convert said firearm to one of a muzzle-loading variety, comprising:

an elongate body member having an outer surface that is conformably shaped for mating engagement with the interior of the breech of the firearm and having a pair of opposed ends, the body member being formed with a primer-receiving chamber at one end and means for establishing communication between the primer-receiving chamber and the opposite end, the communicating means including a passageway to the primer-receiving chamber, at least a pair of generally parallel, non-axial passages to the opposing end, and an intermediate passage establishing communication between each one of the pair of non-axial passages and the axial passage.

2. The device of claim 1, wherein said body member is slidably insertable into and removable from the breech of the firearm.

3. The device of claim 1, including valve means formed in the body member and proximate the opposing end thereof for sealing the axial passage in response to detonation of a charge placed proximate the opposing end.

4. The device of claim 3, wherein the valve means comprises a generally flat, annular disc element that is slidably attached to the opposing end of and coaxial with the body member, the disc element being configured to simultaneously close each of the non-axial passages when disposed in confronting, contiguous relation to the opposing end.

5. The device of claim 3, wherein there is formed a generally cylindrical valve chamber at a junction defined by the intersection between the intermediate passage and the axial passage; and the valve means includes a cylindrical valve element slidably contained in the valve chamber, the valve element being movable from a first position that establishes communication between the axial passage and the intermediate passage to a second position that closes the axial passage.

6. The device of claim 1, including adjustment means formed in the body member for causing axial translation of a primer that is inserted in the primer-receiving chamber.

7. A conversion plug for insertion into a breech of a breech-loading firearm to allow the firearm to be loaded from the muzzle of the firearm, the plug comprising:

an elongate body member having an outer surface that is conformably shaped for mating engagement with the interior of the breech of the firearm and having opposed ends, the body member being formed with a primer-receiving chamber at one end and means for communicating the primer-receiving chamber to the interior of the breech of the firearm, the communicating means including a first passage to the primer-receiving chamber and at least a second passage communicating the first passage to the interior of the breech of the firearm, the second passage having at least a generally non-parallel component relative to the first passage.

8. The conversion plug of claim 7, wherein a portion of the body member proximate the opposed end is formed to have a reduced section relative to that of the remainder of the body member and the second passage lies substantially transverse the body member to communicate the first passage to a surface of the portion.

9. The conversion plug of claim 8, including at least a pair of generally parallel, non-axial passages communicating the transverse passage to the opposed end of the body member.

10. In a firearm having a barrel that is adapted to be loaded from a breech end of the barrel, a conversion plug adapted to be removably inserted into the breech end of the barrel to convert the firearm to one of a muzzle-loading variety, the conversion plug comprising:

a plug body having a pair of opposed ends, and an axial throughbore extending between the opposed ends, the plug body being conformably shaped for mating engagement with the interior of the breech of the firearm;

an adjustment element fitted in the throughbore and rotatably engageable therewith for allowing axial translation of the adjustment element relative to the plug body, the adjustment element having a pair of opposed ends and at least one passage to communicate the one end of the adjustment element to the opposing end thereof, the adjustment element being relatively positioned in the plug body to locate the one end of the adjustment element interior of said throughbore and forming a primer-receiving chamber, the primer-receiving chamber having an axial dimension that is varied with axial translation of the adjustment element; and restriction means coupled to the adjustment element for communicating detonation products of a detonated primer that is inserted in the primer-receiving chamber from the primer-receiving chamber and through the adjustment element and for preventing gases caused by combustion of a powder charge to be passed through the adjustment element to the primer-receiving chamber.

11. The conversion plug of claim 10, wherein the restriction means includes a first interior component of the passage that opens at the one end of the adjustment element, a second interior component of the passage opening at the opposing end of the adjustment element, the first and second components being non-axial relative to one another, and a third interior component of the passage that communicates the first component to the second component.

12. The conversion plug of claim 10, wherein the restriction means includes valve means situated in the passage for closing the passage in response to combustion of a powder charge, the valve means comprising a valve chamber formed in the adjustment element and containing a valve element that is movable from a first position that opens the passage to establish communication between the opposing ends of the adjustment element to a second position that closes the passage.

13. The conversion plug of claim 10, wherein the restriction means includes a generally flat, annular disc element that is slidably mounted to the other end of the adjustment element in confronting relation thereto, the disc element being configured, and the passage opening at the other end of the adjustment element having positioned, to close the passage in response to combustion of the powder charge.

* * * * *